US008968976B2

(12) United States Patent
Shimizu et al.

(10) Patent No.: US 8,968,976 B2
(45) Date of Patent: Mar. 3, 2015

(54) METHOD FOR REGENERATING CARRIER CORE MATERIAL FOR ELECTROPHOTOGRAPHY, METHOD FOR MANUFACTURING CARRIER FOR ELECTROPHOTOGRAPHY, AND CARRIER FOR ELECTROPHOTOGRAPHY

(71) Applicants: Takayuki Shimizu, Shizuoka (JP); Kazumi Ohtaki, Shizuoka (JP); Shinichiro Yagi, Shizuoka (JP); Takeshi Sako, Shizuoka (JP); Idzumi Okajima, Shizuoka (JP)

(72) Inventors: Takayuki Shimizu, Shizuoka (JP); Kazumi Ohtaki, Shizuoka (JP); Shinichiro Yagi, Shizuoka (JP); Takeshi Sako, Shizuoka (JP); Idzumi Okajima, Shizuoka (JP)

(73) Assignees: Ricoh Company, Ltd., Tokyo (JP); National University Corporation Shizuoka University, Shizuoka-shi (JP)

( * ) Notice: Subject to any disclaimer, the term of this patent is extended or adjusted under 35 U.S.C. 154(b) by 73 days.

(21) Appl. No.: 13/625,422

(22) Filed: Sep. 24, 2012

(65) Prior Publication Data

US 2013/0078567 A1 Mar. 28, 2013

(30) Foreign Application Priority Data

Sep. 26, 2011 (JP) ..... 2011-209577

(51) Int. Cl.
*G03G 9/113* (2006.01)
*G03G 9/10* (2006.01)
*G03G 9/107* (2006.01)

(52) U.S. Cl.
CPC ..... *G03G 9/10* (2013.01); *G03G 9/107* (2013.01); *G03G 9/1131* (2013.01); *G03G 9/1139* (2013.01)
USPC ..... 430/137.1; 430/110.2

(58) Field of Classification Search
USPC ..... 430/110.2, 137.1
See application file for complete search history.

(56) References Cited

U.S. PATENT DOCUMENTS

| | | | | |
|---|---|---|---|---|
| 5,728,910 | A | 3/1998 | Matsubara et al. | |
| 6,464,797 | B1 * | 10/2002 | Sugiyama et al. | 134/10 |
| 2011/0136057 | A1 * | 6/2011 | Ohtaki et al. | 430/110.2 |

FOREIGN PATENT DOCUMENTS

| | | |
|---|---|---|
| GB | 1367478 A | 9/1974 |
| JP | 47-012286 | 6/1972 |
| JP | 62-061948 | 12/1987 |
| JP | 05-031000 | 2/1993 |
| JP | 05-127432 | 5/1993 |

(Continued)

OTHER PUBLICATIONS

Translation of JP 2007-206614 published Aug. 2007/.*

*Primary Examiner* — Peter Vajda
(74) *Attorney, Agent, or Firm* — Oblon, McClelland, Maier & Neustadt, L.L.P.

(57) ABSTRACT

A method for regenerating a carrier core material for electrophotography, including: treating a carrier for electrophotography including a carrier core material for electrophotography and a coating layer on a surface of the carrier core material for electrophotography with an aqueous solution including an oxidant in a subcritical state or a supercritical state having a temperature of 280° C. or greater and a density of 0.20 g/cm$^3$ or greater, wherein an amount of the oxidant in a total amount of the aqueous solution used in the treating is greater than 0.05 parts by mass with respect to 1 part by mass of the carrier for electrophotography to be treated in the treating.

12 Claims, 3 Drawing Sheets

(56) References Cited

FOREIGN PATENT DOCUMENTS

| | | | | |
|---|---|---|---|---|
| JP | 05-197211 | 8/1993 | | |
| JP | 05-216282 | 8/1993 | | |
| JP | 05-216283 | 8/1993 | | |
| JP | 06-149132 | 5/1994 | | |
| JP | 06-194881 | 7/1994 | | |
| JP | 07-114221 | 5/1995 | | |
| JP | 08-087137 | 4/1996 | | |
| JP | 09-111249 | 4/1997 | | |
| JP | 10-024274 | 1/1998 | | |
| JP | 2001-290311 | 10/2001 | | |
| JP | 2002-244351 | 8/2002 | | |
| JP | 2003-098762 | 4/2003 | | |
| JP | 2007-206614 | * 8/2007 | ..... | G03G 9/113 |
| JP | 4244197 | 1/2009 | | |
| JP | 4583316 | 9/2010 | | |

* cited by examiner

METHOD FOR REGENERATING CARRIER CORE MATERIAL FOR ELECTROPHOTOGRAPHY, METHOD FOR MANUFACTURING CARRIER FOR ELECTROPHOTOGRAPHY, AND CARRIER FOR ELECTROPHOTOGRAPHY

BACKGROUND OF THE INVENTION

1. Field of the Invention

The present invention relates to a method for regenerating a carrier core material for electrophotography, a method for manufacturing a carrier for electrophotography, and a carrier for electrophotography.

2. Description of the Related Art

A so-called two-component developer including a mixture of carrier particles and toner particles is frequently used in electrophotography. These carrier particles are formed, for example, from magnetic particles and a resin. These include a configuration that a coating layer including a resin as a main component is formed on a surface of relatively large magnetic particles and a configuration that a relatively small magnetic powder is uniformly dispersed in a resin.

With a conventional developer, degradation of carrier characteristics such as cracking, chipping and peeling of carrier surface and so-called spent carrier that a toner film is formed on a carrier surface due to repeated use over a long period of time has been a problem. In order to solve this problem, there have been various improvements proposed in regard to types of resins coating a carrier and crosslinking methods (for example, see Japanese Patent Application Laid-Open (JP-A) Nos. 05-127432, 05-216282, 05-216283, 05-197211, 07-114221, 08-87137 and 06-194881, and Japanese Patent Application Publication (JP-B) No. 62-61948).

In recent years, environmental destruction caused by industrial waste has become a problem, and reuse of a developer after use has become one of the challenges. However, until now, a developer after use cannot be reused and has been discarded even though carrier characteristics are improved during use.

Therefore, with respect to this reuse of a developer, a method for restoring performance by removing a spent toner on a carrier surface has been proposed. Also, a method for recovering a carrier core material by removing a resin which firmly coats a surface of a carrier core material as magnetic particles and providing again a coating resin to regenerate it as a carrier has been proposed.

For example, as the method for restoring performance by removing a spent toner on a carrier surface, a technique to remove the spent toner on the carrier surface by heating and solvent cleaning (see JP-A No. 6-149132). With this proposed technique, mainly a carrier degraded due to a spent toner may be recycled.

With this proposed technique, however, when degradation of performance is not only due to a spent toner but also due to cracking, chipping and peeling of a resin coating a surface of a carrier core material, the performance cannot be restored, or the carrier cannot be reused, only by removing the spent toner. Also, despite using this proposed technique, there is a spent toner which is difficult to remove, and thus a more powerful removing technique is desired. Further, when a carrier is washed with a solvent, a more environmentally low-impact technique is desired, considering post-processing of the solvent itself.

For example, as a method for removing a resin firmly covering a surface of a carrier core material, a technique to burn a collected developer at around 1,000° F. so as to remove the covering resin from the carrier core material has been proposed (see JP-A No. 47-12286). With this technique, it is possible to remove a coating resin from a carrier which is coated with a thermoplastic resin such as acrylic resin.

However, when a thermosetting resin is used as a coating resin of a carrier, there is a problem that decomposition of the coating resin is insufficient. Also, when a ferrite core material as a metal suboxide imparting desired magnetic properties is used and regenerated by this conventional technique, there is a problem that the original properties of the core material cannot be restored.

As described above, the conventional techniques have not achieved a method for regenerating a carrier which satisfies both conditions for removing a chemically and mechanically firm coat layer from a carrier core material and conditions not to sacrifice performance of the carrier core material imparting desired magnetic properties. Especially, since a carrier core material is usually a metal suboxide having a specific crystalline structure, chemical changes such as oxidation or changes in the crystalline structure must be avoided in a recycling process. However, for a carrier composed of particles of a metal suboxide having a specific crystalline structure and a coat layer, there has been no prior art to recover the carrier core material without involving oxidation or reduction to the oxide as well as disturbing the crystalline state, i.e. to recover the carrier core material without degrading its magnetic properties.

Meanwhile, as a technique to decompose a resin, a technique to decompose a resin in water in a supercritical state or a subcritical state is proposed (see JP-A No. 05-31000). Also, a technique to decompose a thermosetting resin in water in a supercritical state or a subcritical state is proposed (see JP-A No. 10-24274). In addition, a technique to process a chlorine-containing plastic waste using supercritical water is proposed (JP-A No. 9-111249). These proposed techniques are performed mainly for the purpose of monomerizing a large quantity of resin waste for detoxification as well as turning it into a raw material, and conditions suitable for the purpose are proposed. Thus, regeneration of a carrier core material is not considered at all.

Regarding a method for processing a carrier, a quick and efficient processing technique to treat a carrier in subcritical water at 280° C. or below containing hydrogen peroxide is proposed (see JP-A No. 2007-206614). With this proposed technique, it is disclosed that an effect of removing a coating resin is improved when a weight of a solvent with respect to a weight of the carrier is increased while maintaining a constant concentration of an oxidant.

Also, a technique to remove a coating resin without affecting magnetic properties of a carrier core material as a magnetic body by means of a method for removing a carrier coating resin using subcritical water at 280° C. or less has been proposed (see Japanese Patent (JP-B) No. 4244197).

However, in these proposed techniques, there is a problem that it takes a long time to remove a specific resin film to some extent since the decomposition condition is subcritical, which imparts low capacity of resin decomposition compared to supercritical condition. Also, it is necessary to heat for a long time, and consequently thermal energy cost increases. Further, a coating resin layer of a carrier includes an electrically conductive material such as silica, alumina and carbon black for the purpose of controlling electrical conductivity of the carrier itself. However, there is a problem with these proposed techniques that metal particles such as silica and alumina cannot be removed even though a resin may be removed to some extent. Also, with these proposed techniques, an operation to separate a toner from a developer recovered from the market is required in recycling carrier core materials, and there is a problem that the increased number of steps reduces production efficiency and increases running cost.

As described above, supercritical water or subcritical water is effective for treating an object to be processed, but it is also important to set treating conditions considering economic efficiency. High-temperature and high-pressure conditions improve decomposition performance, which is effective for treating an object to be processed, but it restricts equipment specifications, resulting in high cost.

Accordingly, it is desired at present to provide: a method for regenerating a carrier core material for electrophotography which quickly and efficiently separates and removes a resin firmly coating the carrier core material for electrophotography without excessive high-temperature and high-pressure conditions, does not affect properties of the carrier core material for electrophotography and provides sufficient performance as a carrier for electrophotography even after a resin is coated again; a carrier core material for electrophotography obtained by the method for regenerating a carrier core material for electrophotography; and a carrier for electrophotography using the carrier core material for electrophotography.

SUMMARY OF THE INVENTION

The present invention aims at solving the above problems in the conventional technologies and at achieving the following objection. That is, the present invention aims at providing a method for regenerating a carrier core material for electrophotography which quickly and efficiently separates and removes a resin firmly coating the carrier core material for electrophotography without excessive high-temperature and high-pressure conditions, does not affect properties of the carrier core material for electrophotography and provides sufficient performance as a carrier for electrophotography even after a resin is coated again.

The present inventors conducted extensive studies to solve the aforementioned problems. As a result, they unexpectedly found that, by treating a carrier for electrophotography including a carrier core material for electrophotography and a coating layer on a surface of the carrier core material for electrophotography with an aqueous solution including an oxidant in a subcritical state or a supercritical state having a temperature of 280° C. or greater and a density of 0.20 g/cm$^3$ or greater, wherein an amount of the oxidant in a total amount of the aqueous solution used in the treating is greater than 0.05 parts by mass with respect to 1 part by mass of the carrier for electrophotography to be treated in the treating, it is possible to separate the coating layer from the carrier core material for electrophotography without excessive high-temperature and high-pressure conditions and to regenerate the carrier core material for electrophotography without changing properties such as magnetic properties and electrical properties, and thus they completed the present invention.

The present invention is based on the aforementioned findings by the present inventors, and means for solving the problems are as follows. That is:

A method for regenerating a carrier core material for electrophotography of the present invention includes treating a carrier for electrophotography including a carrier core material for electrophotography and a coating layer on a surface of the carrier core material for electrophotography with an aqueous solution including an oxidant in a subcritical state or a supercritical state having a temperature of 280° C. or greater and a density of 0.20 g/cm$^3$ or greater, wherein an amount of the oxidant in a total amount of the aqueous solution used in the treating is greater than 0.05 parts by mass with respect to 1 part by mass of the carrier for electrophotography to be treated in the treating.

According to the present invention, it is possible to solve the aforementioned problems in the prior art and to provide a method for regenerating a carrier core material for electrophotography which quickly and efficiently separates and removes a resin firmly coating the carrier core material for electrophotography without excessive high-temperature and high-pressure conditions, does not affect properties of the carrier core material for electrophotography and provides sufficient performance as a carrier for electrophotography even after a resin is coated again.

DETAILED DESCRIPTION OF THE INVENTION

Figure 1:
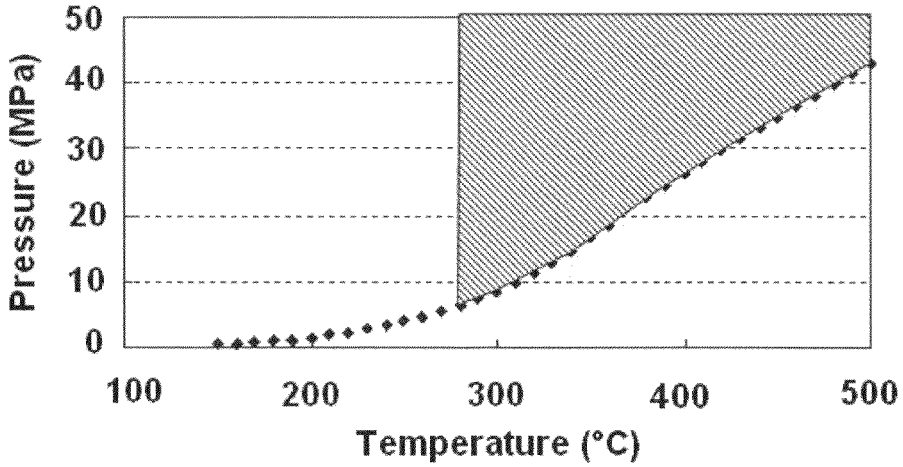
FIG. 1 is a diagram illustrating a relation between temperature and pressure in the present invention.

Method for Regenerating Carrier Core Material for Electrophotography, and Carrier Core Material for Electrophotography A method for regenerating a carrier core material for electrophotography includes at least a treating step, preferably includes a catalyst contacting step and a cleaning step, and further includes other steps according to necessity.

A carrier core material for electrophotography of the present invention is obtained by the method for regenerating a carrier core material for electrophotography of the present invention.

<Treating Step>

The treating step is a step to treat a carrier for electrophotography with an aqueous solution including an oxidant in a subcritical state or a supercritical state having a temperature of 280° C. or greater and a density of 0.20 g/cm$^3$ or greater.

An amount of the oxidant in a total amount of the aqueous solution used in the treating step is greater than 0.05 parts by mass with respect to 1 part by mass of the carrier for electrophotography to be processed in the treating step.

—Carrier for Electrophotography—

The carrier for electrophotography includes a carrier core material for electrophotography and a coating layer, and it further includes other components according to necessity.

The carrier for electrophotography may be at a state of being mixed with a toner, i.e. a state of a developer for electrophotography.

The carrier for electrophotography may be of after use, or it may be an unused one requiring removal of a coating layer for reuse.

—Carrier Core Material for Electrophotography—

A material for the carrier core material for electrophotography is not particularly restricted and may be appropriately selected according to purpose. Examples thereof include: a ferromagnetic metal such as iron, cobalt and nickel; a metal oxide such as magnetite, hematite and ferrite; and a composite of ferromagnetic fine particles and a resin. These may be used alone or in combination of two or more.

A volume-average particle diameter of the carrier core material for electrophotography is not particularly restricted and may be appropriately selected according to purpose, and it is preferably 10 μm to 1,000 μm.

Here, the volume-average particle diameter may be measured using, for example, MICROTRAC particle size analyzer SRA (manufactured by Nikkiso Co., Ltd.).

The method for regenerating a carrier core material for electrophotography may be applied to a carrier core material for electrophotography of any material, regardless of the material carrier core material for electrophotography.

—Coating Layer—

The coating layer is formed on a surface of the carrier core material for electrophotography.

A material of the coating layer is not particularly restricted and may be appropriately selected according to purpose. Examples thereof include: a polyolefin resin such as polyethylene, polypropylene, chlorinated polyethylene and chlorosulfonated polyethylene; polyvinyl and polyvinylidene resins such as polystyrene, acrylics (e.g., polymethylmethacrylate), polyacrylonitrile, polyvinyl acetate, polyvinyl alcohol, polyvinyl butyral, polyvinyl chloride, polyvinyl carbazole, polyvinyl ether and polyvinyl ketone; a vinyl acetate-vinyl chloride copolymer; a silicone resin including an organosiloxane bond or a modified product thereof (e.g. modified by an alkyd resin, a polyester resin, an epoxy resin or a polyurethane resin); a fluorine resin such as polytetrafluoroethylene, polyvinyl fluoride, polyvinylidene fluoride and polychlorotrifluoroethylene; polyamide; polyester; polyurethane; polycarbonate; an amino resin such as urea-formaldehyde resin; and an epoxy resin.

Among these, a silicone resin or a modified product thereof which is difficult to remove with conventional heating or dissolving is preferable. The silicone resin or the modified product thereof may be crosslinked by heat treatment or with a crosslinking agent.

A coating layer that a thermally crosslinking resin is cured, especially a coating layer that a thermally crosslinking silicone resin is cured, is difficult to remove from a carrier for electrophotography since it is not only stable against many acids and bases but also insoluble in solvents. It is also difficult to remove from a carrier for electrophotography similarly by burning.

However, using a method for regenerating a carrier core material for electrophotography of the present invention, a coating layer which is conventionally difficult to remove from a carrier core material for electrophotography may be removed.

The coating layer may include fine particles in order to control a volume resistivity thereof.

The particles may significantly improve strength of the coating layer by selecting appropriate amount and particle diameter with respect to a thickness of the coating layer. Also, by selecting an electrically conductive material as the particles, the volume resistivity of the coating layer may be adjusted.

The particles are not particularly restricted and may be appropriately selected from heretofore known materials according to purpose. Examples thereof include carbon black, alumina, titanium oxide, zinc oxide, silica, potassium titanate, aluminum borate, calcium carbonate, tin oxide, indium oxide, tin oxide-antimony oxide and tin oxide-indium oxide. These may be surface-treated.

Among these, particles of titanium oxide and alumina are particularly preferable in view of negatively charging a toner and easily controlling the volume resistivity of the coating layer in a desired range.

These may be used alone or in combination of two or more.

A method for forming the coating layer on a surface of the carrier core material for electrophotography is not particularly restricted and may be appropriately selected according to purpose. Examples thereof include a method for applying a coating solution including a material constituting the coating layer to a surface of the carrier core material for electrophotography by a spraying or dipping method.

An average thickness of the coating layer is not particularly restricted and may be appropriately selected according to purpose, and it is preferably 1.0 μm or less, and more preferably 0.02 μm to 0.8 μm.

Here, the average thickness of the coating layer may be measured by observing a cross-sectional area of the carrier using a transmission electron microscopy (TEM).

A method for regenerating a carrier core material for electrophotography is not restricted to the material and the thickness of the coating layer and may be applied to a carrier for electrophotography including the coating layer of any material and thickness.

—Toner—

The toner is not particularly restricted and may be appropriately selected according to purpose. Examples thereof include a toner including at least a binder resin, a colorant and a releasing agent and further including other components according to necessity.

The binder resin is not particularly restricted and may be appropriately selected according to purpose.

The colorant is not particularly restricted and may be appropriately selected according to purpose.

The releasing agent is not particularly restricted and may be appropriately selected according to purpose.

The toner may be one manufactured by any manufacturing method. Examples thereof include a toner manufactured by: a pulverization method; and a suspension polymerization method, emulsion polymerization method or the polymer suspension method that emulsifies, suspends or agglomerates, respectively, an oil phase in an aqueous medium to form toner base particles.

A toner concentration in the developer for electrophotography is not particularly restricted and may be appropriately selected according to purpose, and it is preferably 0.1% by mass or greater, and more preferably 0.1% by mass to 15% by mass. When the toner concentration exceeds 15% by mass, a throughput may significantly decrease depending on a treating method and an oxidant.

The method for regenerating a carrier core material for electrophotography is not restricted to the material and the thickness of the toner and may be applied to the developer for electrophotography including the toner of any material and manufacturing method and any carrier for electrophotography.

—Aqueous Solution Including Oxidant—

The aqueous solution including an oxidant includes at least an oxidant and water, and it further includes other components according to necessity.

—Oxidant—

The oxidant is not particularly restricted and may be appropriately selected according to purpose. Examples thereof include oxygen ($O_2$), chlorine ($Cl_2$), hydrogen peroxide ($H_2O_2$), ozone ($O_3$), potassium permanganate ($KMnO_4$), potassium dichromate ($K_2Cr_2O_7$), dilute nitric acid, concentrated nitric acid ($HNO_3$) and sulfuric acid ($H_2SO_4$). Among these, hydrogen peroxide is preferable since it decomposes into water and oxygen, which is harmless to the environment and human body when it is returned from a high-temperature and high-pressure environment to a normal temperature and pressure. Also, oxygen is preferable since it may be obtained relatively easily and it does not adversely affect the environment and human body.

An amount of the oxidant in a total amount of the aqueous solution including the oxidant used in the treating step is preferably greater than 0.05 parts by mass, and more preferably 0.07 parts by mass or greater, with respect to 1 part by mass of the carrier for electrophotography to be processed in the treating step. An upper limit of the amount of the oxidant is not particularly restricted and may be appropriately selected according to purpose.

In the treating step, the carrier for electrophotography may be in a state of being mixed with a toner, i.e. a state of a developer for electrophotography. When the toner is mixed in that manner, the amount of the oxidant is preferably in consideration of the amount of the toner. This is because decomposition of the toner in addition to the decomposition of the coating layer consumes the oxidant when the toner is mixed.

Here, the amount of the oxidant (Y) preferably satisfies Formula (1) below as well. That is, the amount of the oxidant (Y) in a total amount of the aqueous solution including the oxidant used in the treating step is not only greater than 0.05 parts by mass with respect to 1 part by mass of the carrier for electrophotography to be processed in the treating step but also preferably satisfies Formula (1) below.

$$Y \geq 6.23 \times X - 0.03 \qquad \text{Formula (1)}$$

Here, in Formula (1), Y is the amount of the oxidant (in parts by mass) with respect to 1 part by mass of the carrier for electrophotography to be processed in the treating step. X is the amount of the toner (in parts by mass) processed with 1 part by mass of the carrier for electrophotography processed in the treating step, and it includes 0.

By satisfying Formula (1) above, it is possible to treat the carrier core material for electrophotography in an appropriate oxidizing atmosphere, and treatment without affecting properties of the carrier core material for electrophotography (e.g. saturation magnetization, electrical resistivity) is possible.

Here, Formula (1) above is a formula derived from an amount of an oxidant required for oxidative decomposition of organic components in a toner and experimental results of the present invention by the present inventor.

Also, the amount of the oxidant (Y) preferably satisfies Formula (2) below.

$$6.23 \times X + 0.45 \geq Y \qquad \text{Formula (2)}$$

Here, in Formula (2) above, X and Y are equivalent to X and Y in Formula (1), respectively.

When the amount of the oxidant does not satisfy Formula (2) above, that is, the amount of the oxidant is large with respect to an amount of a toner processed with 1 part by mass of the carrier for electrophotography, an oxidizing action is too strong, and the properties of the carrier core material for electrophotography after treating (e.g. saturation magnetization and electrical resistivity) may be affected.

An example of a concentration of the oxidant in the aqueous solution including the oxidant is illustrated when hydrogen peroxide is used as the oxidant. For example, a preferable concentration of hydrogen peroxide may be calculated from an amount of components used in the coating layer and the toner (e.g. C, H or N).

For example, a developer is used for treating, where 7 parts by mass of an aqueous solution including hydrogen peroxide is used with respect to 1 part by mass of a carrier for electrophotography is included in the developer, and a toner concentration in the developer is 1% by mass to 10% by mass. In this case, preferable hydrogen peroxide concentrations are presented in Table 1. At the concentrations described in Table 1, hydrogen peroxide exists as an oxygen radical in a subcritical or supercritical state, and it effectively decomposes a coating layer and the toner. Also, a subcritical reaction or a supercritical reaction is an appropriate oxidation reaction, and it is possible to prevent changes of the properties of the carrier core material for electrophotography (e.g. saturation magnetization or electrical resistivity).

When the hydrogen peroxide concentration is higher than a suitable hydrogen peroxide concentration (for example, when the toner concentration is 1% by mass, hydrogen peroxide concentration of 10% by mass or greater is used for treating), the properties of the carrier core material for electrophotography may be impaired due to strong oxidizing action in addition to removal and separation of the coating layer and the toner. Also, when the hydrogen peroxide concentration is lower than a suitable hydrogen peroxide concentration, a sufficient oxidation reaction does not occur during subcritical or supercritical treating, and the properties (e.g. saturation magnetization, electrical resistivity) of the carrier core material for electrophotography may change.

TABLE 1

| Toner concentration (% by mass) | Hydrogen peroxide concentration (% by mass) |
|---|---|
| 0 | 0.5 ± 0.5 |
| 1 | 1.0 ± 0.5 |
| 2 | 2.0 ± 0.5 |
| 3 | 2.9 ± 0.5 |
| 4 | 3.8 ± 0.5 |
| 5 | 4.7 ± 0.5 |
| 6 | 5.6 ± 0.5 |
| 7 | 6.5 ± 0.5 |
| 8 | 7.3 ± 0.5 |
| 9 | 8.2 ± 0.5 |
| 10 | 9.0 ± 0.5 |

Here, Table 1 excludes a case where the hydrogen peroxide concentration is 0% by mass for the toner concentration of 0% by mass.

That is, the concentration of the oxidant (hydrogen peroxide) (y) and the toner concentration in a developer (x) preferably satisfy Formula (3) and Formula (4) below:

$$y > 0 \qquad \text{Formula (3)}$$

$$0.88x - 0.19 \leq y \leq 0.88x + 0.81 \qquad \text{Formula (4)}$$

—Water—

The water used for the aqueous solution including the oxidant is not particularly restricted and may be appropriately selected according to purpose. Water having less impurities and low electrical conductivity is preferable, pure water is more preferable, and ultrapure water is particularly preferable.

Here, Table 2 below shows electrical conductivity of water in general.

TABLE 2

| Type | Electrical conductivity (μS · cm) |
|---|---|
| Ultrapure water | 0.06 |
| Pure water | 1.00 |

TABLE 2-continued

| Type | Electrical conductivity (μS · cm) |
|---|---|
| Distilled water | 1.00 to 10.0 |
| Tap water | 100 to 200 |

The electrical conductivity of water at 25° C. is preferably 10.0 μS·cm or less, and more preferably 0.1 μS·cm to 2.0 μS·cm. When the electrical conductivity exceeds 10.0 μS·cm, impurities such as ions may increase, and an effect of removing the coating layer may decrease. Since it has an extremely low electrical conductivity, including almost no impurities such as ions, ultrapure water less affects the properties of the carrier core material for electrophotography (e.g. saturation magnetization or electrical resistivity) during treatment.

An amount of the aqueous solution including the oxidant used with respect to the carrier for electrophotography in treating is not particularly restricted and may be appropriately selected according to purpose, and a mass ratio (the aqueous solution including the oxidant/the carrier for electrophotography) is preferably 3 or greater, and more preferably 7 to 20. When the amount used is less than 3, a removal rate of the coating layer and the toner may decrease. Also, when the amount used exceeds 20, processing efficiency may decrease, and an effect of thermal energy costs on processing cost may increase.

Here, the amount of the aqueous solution including the oxidant used with respect to the carrier for electrophotography in the treating step is a mass of the aqueous solution including the oxidant in contact with the carrier for electrophotography at predetermined temperature and pressure conditions. In other words, it is a mass of the water with respect to a mass of the carrier for electrophotography introduced in a processing vessel when a closed apparatus is used in the treating, i.e. in a batch process. When a flow-type apparatus is used, i.e. in a continuous process, it is a total mass of the water which flows in a processing vessel at predetermined temperature and pressure conditions with respect to a total mass of the carrier for electrophotography.

The aqueous solution including the oxidant in a supercritical state or a subcritical state in the treating step has a temperature of 280° C. or greater, preferably 300° C. or greater, and more preferably 320° C. or greater. When the temperature is less than 280° C., a removal rate of the coating layer is insufficient, and the properties of the treated carrier for electrophotography (e.g. saturation magnetization or electrical resistivity) change largely. An upper limit of the temperature is not restricted as long as it is a temperature that may maintain the subcritical state or the supercritical state, and it may be appropriately selected according to purpose. It is preferably 500° C. or less, more preferably 450° C. or less, and particularly preferably 340° C. or less.

The aqueous solution including the oxidant in a supercritical state or a subcritical state in the treating step has a density of 0.20 g/cm$^3$ or greater, preferably 0.30 g/cm$^3$ or greater, and more preferably 0.40 g/cm$^3$ or greater. When the density is less than 0.20 g/cm$^3$, the removal rate of the coating layer is insufficient, and the properties of the treated carrier for electrophotography (e.g. saturation magnetization or electrical resistivity) change largely. An upper limit of the density is not particularly restricted and may be appropriately selected according to purpose, and it is preferably 0.90 g/cm$^3$ or less, and more preferably 0.80 g/cm$^3$ or less.

A pressure in the treating step is not particularly restricted and may be appropriately selected according to purpose, and it is preferably less than 30 MPa, and more preferably less than 25 MPa.

FIG. 1 illustrates one example of a relation between temperature and pressure, provided the temperature and the density conditions are satisfied. In a region where the removing is possible indicated in FIG. 1 (a hatched region in FIG. 1), the aqueous solution including the oxidant satisfies 0.20 g/cm$^3$ or greater.

—Treatment—

A method for treating is not particularly restricted and may be appropriately selected according to purpose. It may be a batch process or a continuous process.

Among these processes, the continuous process is preferable because it enables simultaneous processes of separating a carrier core material for electrophotography and a toner and cleaning the carrier core material for electrophotography.

For example, as the continuous process, a process to separate a coating layer and a toner from a carrier core material for electrophotography by circulating the aqueous solution including the oxidant in a supercritical state or a subcritical state in a processing vessel containing a carrier for electrophotography and to discharge continuously the coating layer and the toner which have been separated outside the processing vessel is preferable. The processing vessel is not particularly restricted and may be appropriately selected according to purpose, and examples thereof include a pressure vessel.

A processing time in the process is not particularly restricted and may be appropriately selected according to purpose. It is preferably 1 minute to 90 minutes, more preferably 1 minute to 60 minutes, and particularly preferably 5 minutes to 30 minutes.

<Catalyst Contacting Step>

The catalyst contacting step is not particularly restricted as long as the aqueous solution including the oxidant in a supercritical state or a subcritical state used in the treating step is brought into contact with a catalyst, and it may be appropriately selected according to purpose.

The aqueous solution including the oxidant used in the treating step includes the coating layer and the toner removed from the carrier core material for electrophotography. By contacting the aqueous solution including the oxidant in a supercritical state or a subcritical state including these with a catalyst, organic substances are decomposed at a lower activation energy. Thus, the organic substances in the coating layer and the toner included in the aqueous solution including the oxidant may be efficiently removed. As a result, an amount of total organic carbon (TOC) of the waste is reduced even at a relatively low temperature, and burden of waste treatment is reduced, or there is no need for waste treatment.

The catalyst is not particularly restricted and may be appropriately selected according to purpose. Examples thereof include a metal catalyst and a metal oxide catalyst. Examples of the metal catalyst include Pt, Rh, Pd, Co, Cr, Mn, Cu, Ce, Fe and Ni. Examples of the metal oxide catalyst include PdO, $SnO_2$, ZnO, $TiO_2$, CeO, $Fe_2O_3$, NiO and $MnO_2$. Among these, $MnO_2$ (manganese dioxide) is preferable since it is easily obtained at relatively low cost and demonstrates high activational effect.

An amount of the catalyst used is not particularly restricted and may be appropriately selected according to purpose. When manganese dioxide ($MnO_2$) is used as the catalyst, the amount is preferably 5 parts by mass or greater, and more preferably 7 parts by mass or greater with respect to 1 part by mass of the carrier for electrophotography. When palladium oxide is used as the catalyst, the amount is preferably 0.3 parts by mass or greater, more preferably 1 parts by mass or greater, and particularly preferably 3 parts by mass with respect to 1 part by mass of the carrier for electrophotography. An upper limit of the amount used is not particularly restricted and may be appropriately selected according to purpose, and it is preferably 20 parts by mass or less, and more preferably 15 parts by mass or less with respect to 1 part by mass of the carrier for electrophotography.

<Cleaning Step>

The cleaning step is not particularly restricted as long as the carrier core material for electrophotography after the treating step is cleaned with water containing air bubbles, and it may be appropriately selected according to purpose.

With the cleaning step, the coating layer and the toner deposited on the carrier core material for electrophotography with weak adhesive force as well as redeposition of particles included in the coating layer after the treating step may be removed.

The air bubbles are not particularly restricted and may be appropriately selected according to purpose, and fine bubbles, so-called microbubbles and nanobubbles, are preferable.

An average bubbles diameter of the air bubbles is not particularly restricted and may be appropriately selected according to purpose. It is preferably 100 μm or less, and more preferably 20 μm or less. When the air bubbles have an average bubble diameter of less than 100 μm, residues adhering to recesses of the carrier core material for electrophotography may be effectively removed.

The average bubble diameter of the air bubbles may be measured using, for example, a laser diffraction/scattering particle size measuring apparatus (LDSA3400A, manufactured by Nikkiso Co., Ltd.).

The method for cleaning is not particularly restricted and may be appropriately selected according to purpose. Examples thereof include: immersing the carrier core material for electrophotography after the treating step into the water containing air bubbles; and placing the carrier core material for electrophotography after the treating step in a processing tank including water and adding the water containing air bubbles to the water in the processing tank.

Also, in the cleaning step, it is preferable to apply ultrasonic vibration to the carrier core material for electrophotography during cleaning. By applying ultrasonic vibration, cleaning effect improves.

Application of ultrasonic vibration to the carrier core material for electrophotography independently of the cleaning step is also effective for removing the coating layer. Thus, the carrier core material for electrophotography may be subjected to ultrasonic vibration without performing the cleaning step. A method for applying ultrasonic vibration to a carrier core material for electrophotography is not particularly restricted and may be appropriately selected according to purpose. Examples thereof include applying ultrasonic vibration to water in which a carrier core material for electrophotography is immersed.

Moreover, cleaning effect improves further by stirring the water containing air bubbles. Removal efficiency may decrease without stirring because deposits detached from the carrier core material for electrophotography continues to float in the vicinity of the carrier core materials for electrophotography. In addition, collision within the carrier core material for electrophotography by stirring also improves removal efficiency.

An electrical conductivity of the water used for cleaning (25° C.) is not particularly restricted and may be appropriately selected according to purpose. It is preferably 10.0 μS·cm or less, and more preferably 1.0 μS·cm or less. That is, water which includes almost no ions is preferable. When the electrical conductivity exceeds 10.0 μS·cm, i.e. the water includes many ions as tap water, ions adhere to a surface of the carrier core material for electrophotography during cleaning, and performance (e.g. electrical resistivity) of the carrier core material for electrophotography may change.

The cleaning step is terminated by removing the carrier core material for electrophotography from the water containing air bubbles.

The number of the cleaning steps is not particularly restricted and may be appropriately selected according to purpose. It is preferably 2 to 6, and more preferably 3 to 5. As the number of the cleaning step increases, residues of the separated coating layer and particles decrease. Especially, particles used for the purpose of adjusting resistivity remaining on a surface of the carrier core material for electrophotography invites changes in magnetic properties (e.g. decrease in saturation magnetization), which is one of the most important properties of the carrier core material for electrophotography, and it is undesirable. Thus, the cleaning step is preferably performed twice or more. Also, when the cleaning step is repeated many times, an yield of cleaning and removal of decomposition decreases, and also partial discharge of the carrier core material for electrophotography occurs, resulting in variation in the average particle diameter of the carrier core material for electrophotography. The variation in the average particle diameter affects a bulk density and fluidity of the developer after regeneration. This is not preferable because it affects toner density control and charged amount. The trend may be more noticeable when the number of cleaning step is 7 or greater.

<Other Steps>

Examples of the other steps include a particle size adjusting step.

—Particle Size Adjusting Step—

The particle size adjusting step is not particularly restricted as long as it adjusts the particle size of the carrier core material for electrophotography separated from the coating layer and the toner, and it may be appropriately selected according to purpose. Examples thereof include a method using a classifier and a method using a sieve.

With the particle size adjusting step, the carrier core material for electrophotography to which the coating layer is adhered and the carrier core material for electrophotography having a large particle size exceeding a desired particle size due to unavoidable reasons may be removed. Also, the carrier core material for electrophotography having a particle size smaller than a desired particle size due to some reasons such as wear and collision may also be removed.

In the method for regenerating a carrier core material for electrophotography, a rate of separation and removal of the coating layer and the toner from the carrier core material for electrophotography is not necessarily 100%. That is, if degradation of the carrier for electrophotography is only near a surface thereof, removing a resin only in the vicinity of the surface suffices. Also, decomposition and dissolution of the coating layer by the aqueous solution including the oxidant in a supercritical state or a subcritical state proceed from a surface of the carrier for electrophotography. Thus, a degree of the decomposition and dissolution may be controlled by processing time.

Even so, the rate of separation of the coating layer (removal rate) is preferably 70% or greater, more preferably 80% or greater, and particularly preferably 90% or greater of the coating layer before treatment. This is because, especially in a case where a carrier for electrophotography is manufactured by mixing a treated carrier core material for electrophotography with a virgin carrier core material for electrophotography and forming a coating layer thereon, difference between the recycled and virgin carrier core materials for electrophotography affects performance of a developer for electrophotography after coating. In particular, to stabilize the manufacturing process for manufacturing a carrier for electrophotography using a recycled carrier core material for electrophotography, higher removal rate of the coating layer is desirable. That is, a carrier core material for electrophotography treated with a high removal rate does not require special conditions and steps since substantially the same manufacturing conditions as a virgin carrier core material for electrophotography may be applied thereto.

Figure 2:
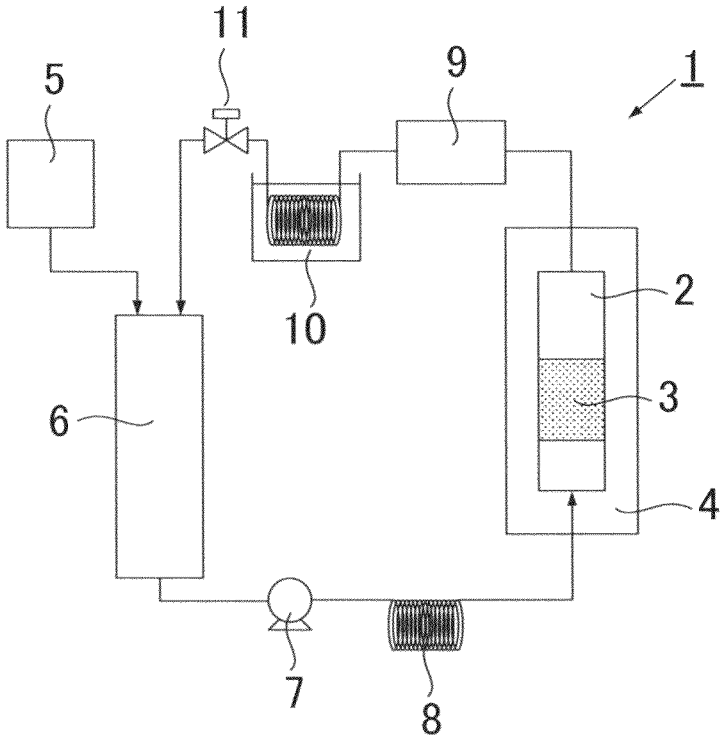
FIG. 2 is a schematic diagram illustrating one example of a flow-type apparatus used in a continuous process.

Here, one example of the method for regenerating a carrier core material for electrophotography is explained in reference to FIG. 2. FIG. 2 is a schematic diagram illustrating one example of a flow-type apparatus 1 used in a continuous process. First, an object to be treated (carrier for electrophotography) 3 is placed in a cylindrical pressure vessel 2. Also, a catalyst is placed in a catalyst container 9. Metal meshes are installed at a top and bottom of the pressure vessel 2 so that a treated carrier core material for electrophotography does not come out of the pressure vessel 2. Pipes are connected to the top and bottom of the pressure vessel 2, which is installed in an electric furnace 4. Next, using a high-pressure liquid supply pump 7 capable of high-accuracy and trace-amount liquid feeding, water is supplied from a reservoir tank 6 at a predetermined flow rate, and the pressure vessel 2 is filled with the water. Once the pressure vessel 2 is completely filled with the water, a back pressure valve 11 is adjusted to increase to a predetermined pressure. Once the pressure in the pressure vessel 2 reaches the predetermined pressure, an oxidant is supplied from an oxidant tank 5 to the reservoir tank 6 at a predetermined flow rate, and an aqueous solution including an oxidant having a predetermined concentration of the oxidant is prepared. Further, the temperature in the pressure vessel 2 is increased to a desired temperature by the electric furnace 4. At this point, the aqueous solution including the oxidant in the pressure vessel 2 is adjusted so that it is in a supercritical state or a subcritical state and has a predetermined density. Also, by a preheater 8, the circulating water including the oxidant is preheated. Once a predetermined time has elapsed, the temperature and pressure in the pressure vessel 2 are returned to a room temperature and an atmospheric pressure. Then, the treated carrier core material for electrophotography is taken out of the pressure vessel 2. If necessary, it is dried for 1 hour using an isothermal drying oven maintained at 100° C. (not shown), and the regenerated carrier core material for electrophotography is obtained. Using this flow-type apparatus 1, it is possible to separate the carrier core material for electrophotography and the coating layer.

Also, the coating layer separated from the carrier core material for electrophotography is discharged from the pressure vessel 2 along with the circulating aqueous solution including the oxidant. Organic substances such as coating layer are removed by this aqueous solution including the oxidant contacting with the catalyst in the catalyst container 9.

The aqueous solution including the oxidant which has passed through the catalyst container 9 is cooled in a cooling tank 10 and then returned again to the reservoir tank 6.

Figure 3:
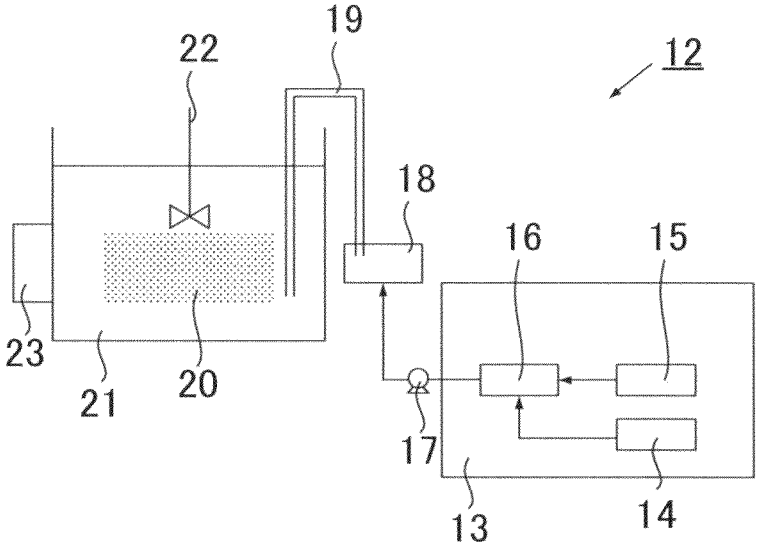
FIG. 3 is a schematic diagram illustrating one example of a cleaning apparatus used in a cleaning step in the present invention.

Next, one example of the cleaning step is explained in reference to FIG. 3. FIG. 3 is a schematic diagram illustrating one example of a cleaning apparatus used in the cleaning step of the present invention. A cleaning apparatus 12 includes a fine air bubble generator 13, a stock tank 18 and a processing tank 21. First, a carrier core material for electrophotography 20 having passed through the treating step of the present invention is placed in the processing tank 21 containing water. Next, while stirring the carrier core material for electrophotography 20 with stirring blades 22, the carrier core material for electrophotography is subjected to ultrasonic vibration generated by an ultrasonic generator 23. While doing so, a pressurized air prepared in a pressurized air supply unit 14 and a pressurized liquid prepared in a pressurized liquid supply unit 15 are mixed in a gas-liquid mixing unit 16, and water containing fine air bubbles (microbubbles) is prepared in the fine air bubble generator 13. The water containing fine air bubbles thus prepared is fed to the stock tank 18 through a pipe by a feed pump 17. The water including fine air bubbles fed to the stock tank 18 is then fed to the processing tank 21 through a fine bubble jet pipe 19. Then, the carrier core material for electrophotography 20 in the processing tank 21 contacts with the water containing fine air bubbles (microbubbles) and is cleaned.

(Carrier for Electrophotography)

A carrier for electrophotography of the present invention includes at least a carrier core material for electrophotography and a coating layer, and it further includes other components according to necessity <Carrier Core Material for Electrophotography>

The carrier core material for electrophotography includes at least the carrier core material for electrophotography of the present invention, and it further includes other carrier core materials for electrophotography according to necessity.

The other carrier core materials for electrophotography are not particularly restricted and may be appropriately selected according to purpose. Examples thereof include a virgin (i.e. non-recycled) carrier core material for electrophotography.

<Coating Layer>

The coating layer is formed on a surface of the carrier core material for electrophotography.

A material of the coating layer is not particularly restricted and may be appropriately selected according to purpose. Examples thereof include the materials exemplified as a material for a coating layer in the method for regenerating a carrier core material for electrophotography of the present invention.

An average thickness of the coating layer is not particularly restricted and may be appropriately selected according to purpose, and it is preferably 1.0 μm or less, and more preferably 0.02 μm to 0.8 μm.

Here, the average thickness of the coating layer may be measured by observing a cross-sectional area of the carrier using a transmission electron microscopy (TEM).

(Method for Manufacturing Carrier for Electrophotography)

A method for manufacturing a carrier for electrophotography of the present invention includes at least the treating step. It preferably includes the catalyst contacting step and/or the cleaning step, and it further includes other steps such as coating layer forming step according to necessity.

A carrier for electrophotography of the present invention may be favorably obtained by the method for manufacturing a carrier for electrophotography of the present invention.

The coating layer forming step is a step of forming the coating layer on a surface of the carrier core material for electrophotography which includes at least the carrier core material for electrophotography obtained through at least the treating step.

The coating layer forming step is not particularly restricted and may be appropriately selected according to purpose. Examples thereof include a method for applying a coating solution including a material constituting the coating layer to a surface of the carrier core material for electrophotography by a spraying or dipping method.

(Developer for Electrophotography)

A developer for electrophotography of the present invention includes at least a carrier for electrophotography and a toner, and it further includes other components according to necessity.

<Carrier for Electrophotography>

The carrier for electrophotography includes at least the carrier for electrophotography of the present invention, and it further includes other carriers for electrophotography according to necessity.

The other carriers for electrophotography are not particularly restricted and may be appropriately selected according to purpose. Examples thereof include a carrier for electrophotography which includes no recycled carrier core material for electrophotography.

<Toner>

The toner is not particularly restricted and may be appropriately selected according to purpose. Examples thereof include a toner including at least a binder resin, a colorant and a releasing agent and further including other components according to necessity.

The binder resin is not particularly restricted and may be appropriately selected according to purpose.

The colorant is not particularly restricted and may be appropriately selected according to purpose.

The releasing agent is not particularly restricted and may be appropriately selected according to purpose.

The toner may be a toner manufactured by any manufacturing method. Examples thereof include a toner manufactured by: a pulverization method; and a suspension polymerization method, emulsion polymerization method or the polymer suspension method that emulsifies, suspends or agglomerates, respectively, an oil phase in an aqueous medium to form toner base particles.

<Method for Manufacturing Developer for Electrophotography>

A method for manufacturing the developer for electrophotography is not particularly restricted and may be appropriately selected according to purpose. Examples thereof include a manufacturing method including a mixing step to mix the carrier for electrophotography and the toner.

EXAMPLES

Hereinafter, the present invention is further described in detail with reference to Examples, which however shall not be construed as limiting the scope of the present invention.

Production Example 1

<Preparation of Carrier B>

—Composition of Coating Layer Forming Solution—

A silicone resin (SR2400, manufactured by Dow Corning Toray Co., Ltd.) . . . 45 parts by mass Toluene . . . 125 parts by mass Alumina (aluminum oxide, manufactured by Sumitomo Chemical Co., Ltd.) . . . 5 parts by mass Using a fluidized bed-type coating apparatus, the coating layer forming solution was applied on a surface of 1,000 parts by mass of spherical ferrite having a volume average particle diameter of 50 μm as a carrier core material for electrophotography to form a coating layer, and Carrier A was obtained. The coating layer had an average thickness of 0.4 μm. Developer A was obtained by mixing 93 parts by mass of Carrier A and 7 parts by mass of a commercially-available toner (RICOH IMAGIO TONER Type 7, manufactured by Ricoh Company, Ltd.).

A copy operation was performed 1 million times using Developer A in a copier, IMAGIO MPC5000 (manufactured by Ricoh Company, Ltd.), and Developer B after use was obtained. Developer B was taken out of the copier, which was blown off to remove a toner, and Carrier B was obtained. At this time, an amount of a spent toner on a surface of Carrier B was only slightly.

Production Example 2

<Preparation of Developer E>

Developer E having a toner concentration of 3% by mass was obtained by mixing 97 parts by mass of Carrier B and 3 parts by mass of a commercially-available toner (RICOH IMAGIO TONER Type 7, manufactured by Ricoh Company, Ltd.).

Example 1

<Regeneration of Carrier Core Material>

In a pressure vessel made of SUS316 (volume content of 25 mL), 1 part by mass of Carrier B was placed, which was incorporated in an apparatus illustrated in FIG. 2. Also, 7 parts by mass of manganese dioxide ($MnO_2$) was placed in a catalyst container. Next, by a syringe pump (manufactured by ISCO), a hydrogen peroxide solution having a hydrogen peroxide concentration adjusted to 1.0% by mass was supplied at an arbitrary flow rate using pure water having an electrical conductivity of 1.6 μS·cm (25° C.). The apparatus was filled with the hydrogen peroxide solution, a pressure in the apparatus was raised to 6.5 MPa, and further a temperature in the pressure vessel was raised to 280° C. with a preheater and an electric furnace. Here, a system in the apparatus was in a subcritical state at that time, having a density of 0.75 g/cm$^3$. Thereafter, 7 parts by mass of a 1.0-% by mass hydrogen peroxide solution was circulated with respect to 1 part by mass of Carrier B (about 30 minutes), and then the pressure vessel was returned to a room temperature and an atmospheric pressure.

Here, the electrical conductivity of water was measured at 25° C. using a hand-held electrical conductivity meter ES-51 (manufactured by Horiba, Ltd.).

Precipitated black ash particles were taken out from a product, and the black ash particles were immersed in a tank containing pure water containing microbubbles (average diameter of the air bubbles: 12 μm) generated using a microbubble generator MA-2 (manufactured by Asupu Co., Ltd.), subjected to ultrasonic vibration over 10 minutes, and cleaned. At this point, the water containing microbubbles was continuously supplied to overflow so that deposits were discharged outside the tank. This step was repeated three times. Thereafter, the particles were dried for 1 hour in an isothermal drying oven maintained at 100° C. for 1 hour, and Evaluation Sample 1 was obtained.

The average diameter of the air bubbles may be measured using a laser diffraction/scattering particle size measuring apparatus (LDSA3400A, manufactured by Nikkiso Co., Ltd.). The bubble diameter was calculated by a histogram method.

<Evaluation>

Evaluation Sample 1 thus obtained was evaluated as follows. Results are shown in Table 5.

—Evaluation of Separation Between Carrier Core Material and Coating Layer—

—Surface Observation by SEM—

Platinum was deposited on Evaluation Sample 1, which was observed in a scanning electron microscope S-2400

(manufactured by Hitachi, Ltd.). As observation conditions, accelerating voltage was 15 kV, and magnification was 2,000 times. As a result, the silicone resin film or the toner was substantially separated and removed from a surface of Evaluation Sample 1, and residual was not observed on the surface of the core material.

Figure 4:
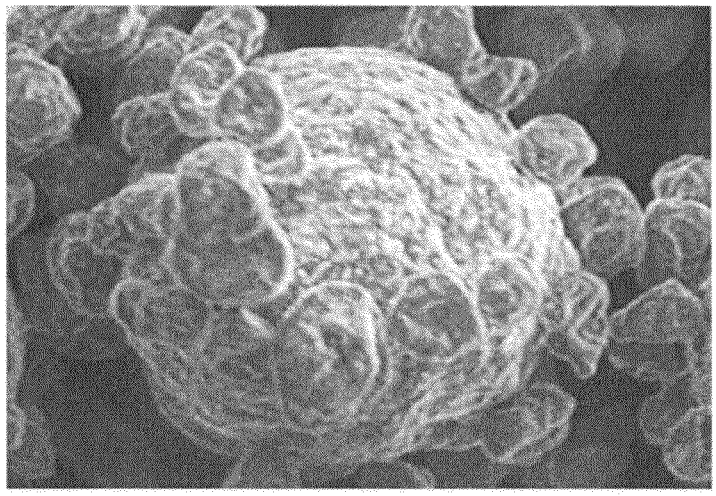
FIG. 4 is an SEM (scanning electron microscope) image of a developer before treatment in Example 1.
Figure 5:
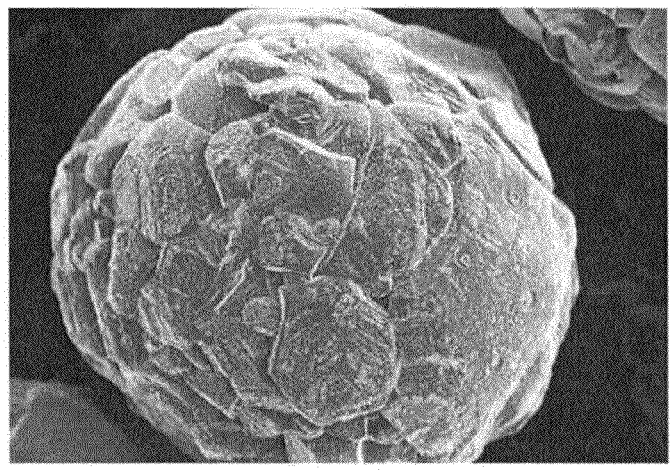
FIG. 5 is an SEM image of a carrier core material after treatment in Example 1.

FIG. 4 is an SEM (scanning electron microscope) image of a developer before the treatment in Example 1, and FIG. 5 is an SEM image of a carrier core material after the treatment.

Also, the surface condition was evaluated based on the following evaluation criteria.

A: Condition close to the surface of the carrier core material prior to forming the coating layer B: Condition that the coating layer is remaining slightly on the surface of the carrier core material C: Condition that about half of the coating layer is remaining on the surface of the carrier core material D: Condition that the surface of the carrier core material is slightly visible E: Condition that the coating layer is hardly removed and that the surface of the carrier core material is not visible.

—Confirmation of Removal of Coating Layer—

An elemental analysis was performed on the surface of Evaluation Sample 1 using an x-ray microanalyzer EMAX 2700 (manufactured by Horiba Ltd.). A detected amount of Si (elemental Si) in Evaluation Sample 1 was compared with a detected amount of Si (elemental Si) in the carrier (Carrier B) were compared, and the removal rate of the silicone resin (the coating layer) was calculated based on the following equation. The removal rate of the coating layer of Evaluation Sample 1 was 97%.

$$\text{Removal Rate} = \frac{(A_{carrier} - A_{sample})}{A_{carrier}}$$

where $A_{carrier}$ is the detected amount of Si in the carrier particles, and $A_{sample}$ is the detected amount of Si in the evaluation sample A detachment condition was evaluated based on the following criteria.

A: The removal rate of the coating layer was 90% or greater.

B: The removal rate of the coating layer was 80% or greater and less than 90%.

C: The removal rate of the coating layer was 65% or greater and less than 80%.

D: The removal rate of the coating layer was 30% or greater and less than 65%.

E: The removal rate of the coating layer was less than 30%.

—Evaluation of Magnetic Property—

Evaluation Sample 1 was measured for its magnetic property in order to confirm changes in the magnetic property. A compact fully-automatic vibrating sample magnetometer (VSM-C7-10A, manufactured by Toei Industry Co., Ltd.) was used as a measuring device, and a saturation magnetization value with application of 1 kOe was measured.

The saturation magnetization value of Evaluation Sample 1 hardly changed from the carrier core material prior to use, and the rate of change was 0.9%.

Regarding the magnetic property, the rate of change with respect to the saturation magnetization value of the carrier core material prior to use (with application of 1 kOe) was evaluated based on the following criteria.

A: the rate of change was less than 1%.

B: the rate of change was 1% or greater and less than 3%.

C: the rate of change was 3% or greater and less than 5%.

D: the rate of change was 5% or greater and less than 10%.

E: the rate of change was 10% or greater.

The rate of change was found from the following equation.

$$\text{Rate of change (\%)} = |[(a-b)/a] \times 100|$$

where "a" represents a saturation magnetization value of a carrier core material prior to use, and "b" represents a saturation magnetization value of the carrier core material (evaluation sample) after treatment.

—Evaluation of Electrical Property—

Evaluation Sample 1 was measured for its electrical property in order to confirm changes in the electrical property. A parallel-electrode resistance measuring device (R8340A, manufactured by Advantest Corporation) was used as a measuring device, and an electrical resistance value with application of 1 kV was measured.

The electrical resistance value of Evaluation Sample 1 hardly changed from the carrier core material prior to use, and the rate of change was 0.6%.

Regarding the electrical property, the rate of change with respect to the electrical resistance value of the carrier core material prior to use (with application of 1 kV) was evaluated based on the following criteria.

A: the rate of change was less than 1%.

B: the rate of change was 1% or greater and less than 3%.

C: the rate of change was 3% or greater and less than 5%.

D: the rate of change was 5% or greater and less than 10%.

E: the rate of change was 10% or greater.

The rate of change was found from the following equation.

$$\text{Rate of change (\%)} = |[(c-d)/c] \times 100|$$

where "c" represents an electrical resistance value of a carrier core material prior to use, and "d" represents an electrical resistance value of the carrier core material (evaluation sample) after treatment.

—Evaluation of Waste Processing Capacity—

To confirm waste treatment capacity of the supercritical treatment, the aqueous solution including the oxidant after regeneration of the carrier core material was measured for its TOC (total organic carbon). TOC-VCSN (manufactured by Shimadzu Corporation) was used as a measuring device, and a combustion oxidation-infrared ray TOC analysis was performed.

As a result, the TOC of the waste of Evaluation Sample 1 was 3 mg/L.

The evaluation of the waste processing capacity was measured based on the following evaluation criteria.

A: The TOC measured value was less than 14 mg/L.

B: The TOC measured value was 14 mg/L or greater and less than 50 mg/L.

C: The TOC measured value was 50 mg/L or greater and less than 100 mg/L.

D: The TOC measured value was 100 mg/L or greater and less than 150 mg/L.

E: The TOC measured value was 150 mg/L or greater.

—Overall Evaluation—

Based on the results of the above evaluations, the overall evaluation was performed based on the following criteria.

A: The carrier core material may be recycled immediately.

B: The carrier core material may be recycled after some treatment; the carrier core material may be recycled immediately, and the waste treatment is required.

C: Recycling of the carrier core material is difficult.

E: Recycling of the carrier core material is impossible.

Example 2

<Preparation of Developer C>

Developer C having a toner density of 12% by mass was obtained by mixing 88 parts by mass of Carrier B and 12 parts by mass of a commercially available toner (RICOH IMAGIO TONER TYPE 7, manufactured by Ricoh Company, Ltd.).

<Regeneration of Carrier Core Material>

In a pressure vessel made of SUS316 (volume content of 25 mL), 1 part by mass of Carrier C was placed, which was incorporated in an apparatus illustrated in FIG. 2. Also, 5 parts by mass of manganese dioxide ($MnO_2$) was placed in a catalyst container. Next, by a syringe pump (manufactured by ISCO), a hydrogen peroxide solution having a hydrogen peroxide concentration adjusted to 10.6% by mass was supplied at an arbitrary flow rate using pure water having an electrical conductivity of 1.6 μS·cm (25° C.). The apparatus was filled with the hydrogen peroxide solution, a pressure in the apparatus was raised to 23.0 MPa, and further a temperature in the pressure vessel was raised to 380° C. with a preheater and an electric furnace. Here, a system in the apparatus was in a supercritical state at that time, having a density of 0.21 g/cm$^3$. Thereafter, 7 parts by mass of a 10.6-% by mass hydrogen peroxide solution was circulated with respect to 1 part by mass of Carrier C (about 30 minutes), and then the pressure vessel was returned to a room temperature and an atmospheric pressure.

Thereafter, the microbubble treatment and the ultrasonic treatment were performed in the same manner as Example 1, and Evaluation Sample 2 was obtained.

Evaluation Sample 2 was evaluated in the same manner as Example 1. Results are shown in Table 5.

As a result, it was confirmed from an electron microscopic observation of Evaluation Sample 2 that the silicone resin on the carrier surface (coating layer) was substantially removed. Also, the removal rate of the coating layer was 98%. The magnetic property hardly changed from the carrier core material prior to use, and the rate of change was 0.2%. Similarly, the electrical property hardly changed from the carrier core material prior to use, and the rate of change was 0.9%. Also, the TOC measurement value of the waste in Example 2 was 5 mg/L, and it was found that there were almost no organic pollutants.

<Reusability of Evaluation Sample>

Also, a carrier and a developer was manufactured using Evaluation Sample 2 thus obtained, and the developer was evaluated for its properties.

—Composition of Coating Layer Forming Solution—

A silicone resin (SR2400, manufactured by Dow Corning Toray Co., Ltd.) . . . 45 parts by mass Toluene . . . 125 parts by mass Alumina (aluminum oxide, manufactured by Sumitomo Chemical Co., Ltd.) . . . 5 parts by mass Using a fluidized bed-type coating apparatus, the coating layer forming solution was applied on a surface of 1,000 parts by mass of Evaluation Sample 2 as a carrier core material for electrophotography to form a coating layer, and Carrier for Electrophotography C was obtained. The coating layer had an average thickness of 0.4 μm. Developer C-1 was obtained by mixing 93 parts by mass of Carrier for Electrophotography C and 7 parts by mass of a commercially-available toner (RICOH IMAGIO TONER TYPE 7, manufactured by Ricoh Company, Ltd.).

Properties of Developer C-1 satisfied general shipping criteria of a developer (e.g. shipping criteria of a developer of Ricoh Company, Ltd.), and there was no problem.

Also, a copy operation was performed 1 million times using Developer C-1 in a copier, IMAGIO MPC5000 (manufactured by Ricoh Company, Ltd.), and Developer C-2 after use was obtained. Developer C-2 was taken out of the copier, which was blown off to remove the toner electrostatically. At this time, an amount of a spent toner on a surface of the carrier was only slightly, and there was no problem with the quality issues, including endurance properties.

Example 3

In a pressure vessel made of SUS316 (volume content of 25 mL), 1 part by mass of Developer E was placed, which was incorporated in an apparatus illustrated in FIG. 2. Next, by a syringe pump (manufactured by ISCO), a hydrogen peroxide solution having a hydrogen peroxide concentration adjusted to 4.9% by mass was supplied at an arbitrary flow rate using pure water having an electrical conductivity of 1.6 μS·cm (25° C.). The apparatus was filled with the hydrogen peroxide solution, a pressure in the apparatus was raised to 8.6 MPa, and further a temperature in the pressure vessel was raised to 300° C. with a preheater and an electric furnace. Here, a system in the apparatus was in a subcritical state at that time, having a density of 0.71 g/cm$^3$. Thereafter, 4 parts by mass of a 4.9-% by mass hydrogen peroxide solution was circulated with respect to 1 part by mass of Developer E (about 30 minutes), and then the pressure vessel was returned to a room temperature and an atmospheric pressure.

Thereafter, the microbubble treatment and the ultrasonic treatment were performed in the same manner as Example 1, and Evaluation Sample 3 was obtained.

Evaluation Sample 3 was evaluated in the same manner as Example 1. Results are shown in Table 5.

As a result, it was confirmed from an electron microscopic observation of Evaluation Sample 3 that the silicone resin on the carrier surface (coating layer) was substantially removed. Also, the removal rate of the coating layer was 94%. The magnetic property hardly changed from the carrier core material prior to use, and the rate of change was 0.8%. Similarly, the electrical property hardly changed from the carrier core material prior to use, and the rate of change was 0.5%. Also, the TOC measurement value of the waste in Example 3 was 584 mg/L, and it was found that the organic pollutants were hardly removed.

Example 4

In a pressure vessel made of SUS316 (volume content of 25 mL), 1 part by mass of Developer E was placed, which was incorporated in an apparatus illustrated in FIG. 2. Also, 5 parts by mass of manganese dioxide ($MnO_2$) was placed in a catalyst container. Next, by a syringe pump (manufactured by ISCO), a hydrogen peroxide solution having a hydrogen peroxide concentration adjusted to 2.9% by mass was supplied at an arbitrary flow rate using pure water having an electrical conductivity of 1.6 μS·cm (25° C.). The apparatus was filled with the hydrogen peroxide solution, a pressure in the apparatus was raised to 8.6 MPa, and further a temperature in the pressure vessel was raised to 300° C. with a preheater and an electric furnace. Here, a system in the apparatus was in a subcritical state at that time, having a density of 0.71 g/cm$^3$. Thereafter, 7 parts by mass of a 2.9-% by mass hydrogen peroxide solution was circulated with respect to 1 part by mass of Developer E (about 30 minutes), and then the pressure vessel was returned to a room temperature and an atmospheric pressure.

Precipitated black ash particles were taken out from a product, and the black ash particles were immersed in a tank containing pure water subjected to ultrasonic vibration over 10 minutes, and cleaned. At this point, pure water was continuously supplied to overflow so that deposits were discharged outside the tank. This step was repeated three times. Thereafter, the particles were dried for 1 hour in an isothermal drying oven maintained at 100° C. for 1 hour, and Evaluation Sample 4 was obtained.

Evaluation Sample 4 was evaluated in the same manner as Example 1. Results are shown in Table 5.

As a result, it was confirmed from an electron microscopic observation of Evaluation Sample 4 that most of the silicone resin on the carrier surface (coating layer) was removed. Also, the removal rate of the coating layer was 83%. The magnetic property slightly changed from the carrier core material prior to use, and the rate of change was 2.1%. Similarly, the electrical property slightly changed from the carrier core material prior to use, and the rate of change was 1.7%. Also, the TOC measurement value of the waste in Example 4 was 13 mg/L, and it was found that there were almost no organic pollutants.

Example 5

In a pressure vessel made of SUS316 (volume content of 25 mL), 1 part by mass of Developer E was placed, which was incorporated in an apparatus illustrated in FIG. 2. Also, 5 parts by mass of manganese dioxide ($MnO_2$) was placed in a catalyst container. Next, by a syringe pump (manufactured by ISCO), a hydrogen peroxide solution having a hydrogen peroxide concentration adjusted to 2.9% by mass was supplied at an arbitrary flow rate using pure water having an electrical conductivity of 120.0 μS·cm (25° C.). The apparatus was filled with the hydrogen peroxide solution, a pressure in the apparatus was raised to 20.0 MPa, and further a temperature in the pressure vessel was raised to 300° C. with a preheater and an electric furnace. Here, a system in the apparatus was in a subcritical state at that time, having a density of 0.73 g/cm$^3$. Thereafter, 7 parts by mass of a 2.9-% by mass hydrogen peroxide solution was circulated with respect to 1 part by mass of Developer E (about 30 minutes), and then the pressure vessel was returned to a room temperature and an atmospheric pressure.

Thereafter, the microbubble treatment and the ultrasonic treatment were performed in the same manner as Example 1, and Evaluation Sample 5 was obtained.

Evaluation Sample 5 was evaluated in the same manner as Example 1. Results are shown in Table 5.

As a result, it was confirmed from an electron microscopic observation of Evaluation Sample 5 that most of the silicone resin on the carrier surface (coating layer) was removed. Also, the removal rate of the coating layer was 93%. The magnetic property slightly changed from the carrier core material prior to use, and the rate of change was 2.8%. Similarly, the electrical property slightly changed from the carrier core material prior to use, and the rate of change was 3.5%. Also, the TOC measurement value of the waste in Example 5 was 10 mg/L, and it was found that there were almost no organic pollutants.

Example 6

In a pressure vessel made of SUS316 (volume content of 25 mL), 1 part by mass of Developer E was placed, which was incorporated in an apparatus illustrated in FIG. 2. Also, 6 parts by mass of manganese dioxide ($MnO_2$) was placed in a catalyst container. Next, by a syringe pump (manufactured by ISCO), a hydrogen peroxide solution having a hydrogen peroxide concentration adjusted to 8.0% by mass was supplied at an arbitrary flow rate using pure water having an electrical conductivity of 1.6 μS·cm (25° C.). The apparatus was filled with the hydrogen peroxide solution, a pressure in the apparatus was raised to 12.0 MPa, and further a temperature in the pressure vessel was raised to 320° C. with a preheater and an electric furnace. Here, a system in the apparatus was in a subcritical state at that time, having a density of 0.67 g/cm$^3$. Thereafter, 2 parts by mass of a 8.0-% by mass hydrogen peroxide solution was circulated with respect to 1 part by mass of Developer E (about 20 minutes), and then the pressure vessel was returned to a room temperature and an atmospheric pressure.

Thereafter, the microbubble treatment and the ultrasonic treatment were performed in the same manner as Example 1, and Evaluation Sample 6 was obtained.

Evaluation Sample 6 was evaluated in the same manner as Example 1. Results are shown in Table 5.

As a result, it was confirmed from an electron microscopic observation of Evaluation Sample 6 that much of the silicone resin on the carrier surface (coating layer) was removed. Also, the removal rate of the coating layer was 81%. The magnetic property slightly changed from the carrier core material prior to use, and the rate of change was 2.5%. Similarly, the electrical property slightly changed from the carrier core material prior to use, and the rate of change was 3.9%. Also, the TOC measurement value of the waste in Example 6 was 8 mg/L, and it was found that there were almost no organic pollutants.

Example 7

In a pressure vessel made of SUS316 (volume content of 25 mL), 1 part by mass of Developer E was placed, which was incorporated in an apparatus illustrated in FIG. 2. Also, 5 parts by mass of manganese dioxide ($MnO_2$) was placed in a catalyst container. Next, by a syringe pump (manufactured by ISCO), a hydrogen peroxide solution having a hydrogen peroxide concentration adjusted to 2.9% by mass was supplied at an arbitrary flow rate using pure water having an electrical conductivity of 1.6 μS·cm (25° C.). The apparatus was filled with the hydrogen peroxide solution, a pressure in the apparatus was raised to 35.0 MPa, and further a temperature in the pressure vessel was raised to 350° C. with a preheater and an electric furnace. Here, a system in the apparatus was in a subcritical state at that time, having a density of 0.66 g/cm$^3$. Thereafter, 7 parts by mass of a 2.9-% by mass hydrogen peroxide solution was circulated with respect to 1 part by mass of Developer E (about 30 minutes), and then the pressure vessel was returned to a room temperature and an atmospheric pressure.

Thereafter, the microbubble treatment and the ultrasonic treatment were performed in the same manner as Example 1, and Evaluation Sample 7 was obtained.

Evaluation Sample 7 was evaluated in the same manner as Example 1. Results are shown in Table 5.

As a result, it was confirmed from an electron microscopic observation of Evaluation Sample 7 that most of the silicone resin on the carrier surface (coating layer) was removed. Also, the removal rate of the coating layer was 90%. The magnetic property slightly changed from the carrier core material prior to use, and the rate of change was 2.3%. Similarly, the electrical property slightly changed from the carrier core material prior to use, and the rate of change was 1.3%. Also, the TOC measurement value of the waste in Example 7 was 4 mg/L, and it was found that there were almost no organic pollutants.

Example 8

In a pressure vessel made of SUS316 (volume content of 25 mL), 1 part by mass of Carrier B was placed, which was incorporated in an apparatus illustrated in FIG. 2. Also, 7 parts by mass of manganese dioxide ($MnO_2$) was placed in a catalyst container. Next, by a syringe pump (manufactured by ISCO), a hydrogen peroxide solution having a hydrogen peroxide concentration adjusted to 1.0% by mass was supplied at an arbitrary flow rate using pure water having an electrical conductivity of 1.6 μS·cm (25° C.). The apparatus was filled with the hydrogen peroxide solution, a pressure in the apparatus was raised to 6.5 MPa, and further a temperature in the pressure vessel was raised to 280° C. with a preheater and an electric furnace. Here, a system in the apparatus was in a subcritical state at that time, having a density of 0.75 g/cm$^3$. Thereafter, 7 parts by mass of a 1.0-% by mass hydrogen peroxide solution was circulated with respect to 1 part by mass of Carrier B (about 30 minutes), and then the pressure vessel was returned to a room temperature and an atmospheric pressure. Thus, Evaluation Sample 8 was obtained.

Evaluation Sample 8 was evaluated in the same manner as Example 1. Results are shown in Table 5.

As a result, it was confirmed from an electron microscopic observation of Evaluation Sample 8 that much of the silicone resin on the carrier surface (coating layer) was removed. Also, the removal rate of the coating layer was 81%. The magnetic property slightly changed from the carrier core material prior to use, and the rate of change was 2.9%. Similarly, the electrical property slightly changed from the carrier core material prior to use, and the rate of change was 2.7%. Also, the TOC measurement value of the waste in Example 8 was 2 mg/L, and it was found that there were almost no organic pollutants.

Comparative Example 1

In a pressure vessel made of SUS316 (volume content of 25 mL), 1 part by mass of Developer E was placed, which was incorporated in an apparatus illustrated in FIG. 2. Also, 5 parts by mass of manganese dioxide ($MnO_2$) was placed in a catalyst container. Next, by a syringe pump (manufactured by ISCO), a hydrogen peroxide solution having a hydrogen peroxide concentration adjusted to 2.9% by mass was supplied at an arbitrary flow rate using pure water having an electrical conductivity of 1.6 μS·cm (25° C.). The apparatus was filled with the hydrogen peroxide solution, a pressure in the apparatus was raised to 16.3 MPa, and further a temperature in the pressure vessel was raised to 350° C. with a preheater and an electric furnace. Here, a system in the apparatus was in a subcritical state at that time, having a density of 0.11 g/cm$^3$. Thereafter, 10 parts by mass of a 2.9-% by mass hydrogen peroxide solution was circulated with respect to 1 part by mass of Developer E (about 40 minutes), and then the pressure vessel was returned to a room temperature and an atmospheric pressure.

Thereafter, the microbubble treatment and the ultrasonic treatment were performed in the same manner as Example 1, and Evaluation Sample 9 was obtained.

Evaluation Sample 9 was evaluated in the same manner as Example 1. Results are shown in Table 5.

As a result, it was confirmed from an electron microscopic observation of Evaluation Sample 9 that the silicone resin on the carrier surface (coating layer) was hardly removed. Also, the removal rate of the coating layer was 28%. The magnetic property largely changed from the carrier core material prior to use, and the rate of change was 13.6%. Similarly, the electrical property largely changed from the carrier core material prior to use, and the rate of change was 13.5%. Also, the TOC measurement value of the waste in Comparative Example 1 was 11 mg/L, and it was found that there were almost no organic pollutants.

Comparative Example 2

In a pressure vessel made of SUS316 (volume content of 25 mL), 1 part by mass of Developer E was placed, which was incorporated in an apparatus illustrated in FIG. 2. Also, 5 parts by mass of manganese dioxide ($MnO_2$) was placed in a catalyst container. Next, by a syringe pump (manufactured by ISCO), a hydrogen peroxide solution having a hydrogen peroxide concentration adjusted to 2.9% by mass was supplied at an arbitrary flow rate using pure water having an electrical conductivity of 1.6 μS·cm (25° C.). The apparatus was filled with the hydrogen peroxide solution, a pressure in the apparatus was raised to 35.0 MPa, and further a temperature in the pressure vessel was raised to 250° C. with a preheater and an electric furnace. Here, a system in the apparatus was in a subcritical state at that time, having a density of 0.80 g/cm$^3$. Thereafter, 7 parts by mass of a 2.9-% by mass hydrogen peroxide solution was circulated with respect to 1 part by mass of Developer E (about 30 minutes), and then the pressure vessel was returned to a room temperature and an atmospheric pressure.

Thereafter, the microbubble treatment and the ultrasonic treatment were performed in the same manner as Example 1, and Evaluation Sample 10 was obtained.

Evaluation Sample 10 was evaluated in the same manner as Example 1. Results are shown in Table 5.

As a result, it was confirmed from an electron microscopic observation of Evaluation Sample 10 that the silicone resin on the carrier surface (coating layer) was hardly removed. Also, the removal rate of the coating layer was 32%. The magnetic property largely changed from the carrier core material prior to use, and the rate of change was 12.8%. Similarly, the electrical property largely changed from the carrier core material prior to use, and the rate of change was 11.3%. Also, the TOC measurement value of the waste in Comparative Example 2 was 18 mg/L, and it was found that much of organic pollutants were removed.

Comparative Example 3

In a pressure vessel made of SUS316 (volume content of 25 mL), 1 part by mass of Developer E was placed, which was incorporated in an apparatus illustrated in FIG. 2. Also, 5 parts by mass of manganese dioxide ($MnO_2$) was placed in a catalyst container. Next, by a syringe pump (manufactured by ISCO), pure water having an electrical conductivity of 1.6 μS·cm (25° C.) was supplied at an arbitrary flow rate. The apparatus was filled with the pure water, a pressure in the apparatus was raised to 8.6 MPa, and further a temperature in the pressure vessel was raised to 300° C. with a preheater and an electric furnace. Here, a system in the apparatus was in a subcritical state at that time, having a density of 0.71 g/cm$^3$. Thereafter, 7 parts by mass of pure water was circulated with respect to 1 part by mass of Developer E (about 30 minutes), and then the pressure vessel was returned to a room temperature and an atmospheric pressure.

Thereafter, the microbubble treatment and the ultrasonic treatment were performed in the same manner as Example 1, and Evaluation Sample 11 was obtained.

Evaluation Sample 11 was evaluated in the same manner as Example 1. Results are shown in Table 5.

As a result, it was confirmed from an electron microscopic observation of Evaluation Sample 11 that most of the silicone resin on the carrier surface (coating layer) was removed. Also, the removal rate of the coating layer was 90%. The magnetic property changed from the carrier core material prior to use, and the rate of change was 5.8%. Similarly, the electrical property changed from the carrier core material prior to use, and the rate of change was 9.2%. Also, the TOC measurement value of the waste in Comparative Example 3 was 124 mg/L, and it was found that not many organic pollutants were removed.

Comparative Example 4

In a pressure vessel made of SUS316 (volume content of 25 mL), 1 part by mass of Carrier B was placed, which was incorporated in an apparatus illustrated in FIG. 2. Also, 5 parts by mass of manganese dioxide ($MnO_2$) was placed in a catalyst container. Next, by a syringe pump (manufactured by ISCO), a hydrogen peroxide solution having a hydrogen peroxide concentration adjusted to 2.9% by mass was supplied at an arbitrary flow rate using pure water having an electrical conductivity of 1.6 μS·cm (25° C.). The apparatus was filled with the hydrogen peroxide solution, a pressure in the apparatus was raised to 3.0 MPa, and further a temperature in the pressure vessel was raised to 250° C. with a preheater and an electric furnace. Here, a system in the apparatus was in a subcritical state at that time, having a density of 0.01 g/cm$^3$. Thereafter, 7 parts by mass of a 2.9-% by mass hydrogen peroxide solution was circulated with respect to 1 part by mass of Carrier B (about 30 minutes), and then the pressure vessel was returned to a room temperature and an atmospheric pressure.

Thereafter, the microbubble treatment and the ultrasonic treatment were performed in the same manner as Example 1, and Evaluation Sample 12 was obtained.

Evaluation Sample 12 was evaluated in the same manner as Example 1. Results are shown in Table 5.

As a result, it was confirmed from an electron microscopic observation of Evaluation Sample 12 that most of the silicone resin on the carrier surface (coating layer) was not removed. Also, the removal rate of the coating layer was 35%. The magnetic property changed from the carrier core material prior to use, and the rate of change was 6.2%. The electrical property largely changed from the carrier core material prior to use, and the rate of change was 14.2%. Also, the TOC measurement value of the waste in Comparative Example 4 was 15 mg/L, and it was found that most organic pollutants were removed.

Comparative Example 5

In a pressure vessel made of SUS316 (volume content of 25 mL), 1 part by mass of Carrier B was placed, which was incorporated in an apparatus illustrated in FIG. 2. Next, by a syringe pump (manufactured by ISCO), a hydrogen peroxide solution having a hydrogen peroxide concentration adjusted to 10.0% by mass was supplied at an arbitrary flow rate using pure water having an electrical conductivity of 1.6 μS·cm (25° C.). The apparatus was filled with the hydrogen peroxide solution, a pressure in the apparatus was raised to 18.0 MPa, and further a temperature in the pressure vessel was raised to 280° C. with a preheater and an electric furnace. Here, a system in the apparatus was in a subcritical state at that time, having a density of 0.77 g/cm$^3$. Thereafter, 0.5 parts by mass of a 10.0-% by mass hydrogen peroxide solution was circulated with respect to 1 part by mass of Carrier B (about 30 minutes), and then the pressure vessel was returned to a room temperature and an atmospheric pressure. Thus, Evaluation Sample 13 was obtained.

Evaluation Sample 13 was evaluated in the same manner as Example 1. Results are shown in Table 5.

As a result, it was confirmed from an electron microscopic observation of Evaluation Sample 13 that much of the silicone resin on the carrier surface (coating layer) was removed. Also, the removal rate of the coating layer was 80%. The magnetic property changed from the carrier core material prior to use, and the rate of change was 5.3%. The electrical property largely changed from the carrier core material prior to use, and the rate of change was 12.0%. Also, the TOC measurement value of the waste in Comparative Example 5 was 218 mg/L, and it was found that not much of the organic pollutants were removed.

Tables 3-1 and 3-2 below show the treatment conditions and cleaning condition in Examples 1 to 8 and Comparative Examples 1 to 5.

TABLE 3-1

| | Subcritical or supercritical treatment conditions | | | | | | | | | | |
|---|---|---|---|---|---|---|---|---|---|---|---|
| | Toner conc. (% by mass) | Temp. (° C.) | Pres. (MPa) | State | Density of water including oxidant (g/cm$^3$) | Carrier (delveloper)/ water (mass ratio) | Oxidant conc. (% by mass) | Elec. cond. of water (μS cm) | Catalyst Type | Catalyst Amount | Cleaning condition Cleaning method |
| Example 1 | 0 | 280 | 6.5 | subcritical | 0.75 | 1/7 | 1.0 | 1.6 | $MnO_2$ | 7 | microbubble + ultrasonic vibration |
| Example 2 | 12 | 380 | 23.0 | supercritical | 0.21 | 1/7 | 10.6 | 1.6 | $MnO_2$ | 5 | microbubble + ultrasonic vibration |
| Example 3 | 3 | 300 | 8.6 | subcritical | 0.71 | 1/4 | 4.9 | 1.6 | — | — | microbubble + ultrasonic vibration |
| Example 4 | 3 | 300 | 8.6 | subcritical | 0.71 | 1/7 | 2.9 | 1.6 | $MnO_2$ | 5 | ultrasonic vibration |
| Example 5 | 3 | 300 | 20.0 | subcritical | 0.73 | 1/7 | 2.9 | 120.0 | $MnO_2$ | 5 | microbubble + ultrasonic vibration |
| Example 6 | 3 | 320 | 12.0 | subcritical | 0.67 | 1/2 | 8.0 | 1.6 | $MnO_2$ | 6 | microbubble + ultrasonic vibration |
| Example 7 | 3 | 350 | 35.0 | subcritical | 0.66 | 1/7 | 2.9 | 1.6 | $MnO_2$ | 5 | microbubble + ultrasonic vibration |
| Example 8 | 0 | 280 | 6.5 | subcritical | 0.75 | 1/7 | 1.0 | 1.6 | $MnO_2$ | 7 | — |

TABLE 3-2

| | Subcritical or supercritical treatment conditions | | | | | | | | | | |
|---|---|---|---|---|---|---|---|---|---|---|---|
| | Toner conc. (% by mass) | Temp. (° C.) | Pres. (MPa) | State | Density of water including oxidant ($g/cm^3$) | Carrier (delveloper)/ water (mass ratio) | Oxidant conc. (% by mass) | Elec. cond. of water (μS cm) | Catalyst Type | Catalyst Amount | Cleaning condition Cleaning method |
| Comp. Ex. 1 | 3 | 350 | 16.3 | subcritical | 0.11 | 1/10 | 2.9 | 1.6 | $MnO_2$ | 5 | microbubble + ultrasonic vibration |
| Comp. Ex. 2 | 3 | 250 | 35.0 | subcritical | 0.80 | 1/7 | 2.9 | 1.6 | $MnO_2$ | 5 | microbubble + ultrasonic vibration |
| Comp. Ex. 3 | 3 | 300 | 8.6 | subcritical | 0.71 | 1/7 | 0 | 1.6 | $MnO_2$ | 5 | microbubble + ultrasonic vibration |
| Comp. Ex. 4 | 0 | 250 | 3.0 | subcritical | 0.01 | 1/7 | 2.9 | 1.6 | $MnO_2$ | 5 | microbubble + ultrasonic vibration |
| Comp. Ex. 5 | 0 | 280 | 18.0 | subcritical | 0.77 | 1/0.5 | 10.0 | 1.6 | — | — | — |

In Tables 3-1 and 3-2, "toner conc." denotes a toner concentration in a developer. Thus, in a case where a carrier is used instead of a developer in regenerating a carrier core material, the toner concentration is regarded as 0% by mass. Also, an amount of a catalyst represents the amount in part by mass with respect to 1 part by mass of a developer or a carrier which is subjected to regeneration.

Table 4 shows an amount of toner per 1 part by mass of carrier (part by mass), an amount of oxidant per 1 part by mass of carrier (part by mass) and sufficiency of Equation (1) above.

TABLE 4

| | Toner amount per 1 part of carrier (part) | Oxidant amount per 1 part of carrier (part) | 6.23 × toner amount − 0.03 | Equation (1) Sufficiency |
|---|---|---|---|---|
| Example 1 | 0 | 0.07 | −0.03 | Yes |
| Example 2 | 0.14 | 0.84 | 0.82 | Yes |
| Example 3 | 0.03 | 0.20 | 0.16 | Yes |
| Example 4 | 0.03 | 0.21 | 0.16 | Yes |
| Example 5 | 0.03 | 0.21 | 0.16 | Yes |
| Example 6 | 0.03 | 0.16 | 0.16 | Yes |
| Example 7 | 0.03 | 0.21 | 0.16 | Yes |
| Example 8 | 0 | 0.07 | −0.03 | Yes |
| Comp. Ex. 1 | 0.03 | 0.30 | 0.16 | Yes |
| Comp. Ex. 2 | 0.03 | 0.21 | 0.16 | Yes |
| Comp. Ex. 3 | 0.03 | 0.00 | 0.16 | No |
| Comp. Ex. 4 | 0 | 0.20 | −0.03 | Yes |
| Comp. Ex. 5 | 0 | 0.01 | −0.03 | Yes |

In Table 4, "part" denotes "part by mass".

TABLE 5

| | Carrier core material properties after treatment | | | | | | | Waste processing capacity | | |
|---|---|---|---|---|---|---|---|---|---|---|
| | | Coating layer removal | | Magnetic Property (1 kOe) | | Electrical Property (1 kV) | | TOC | | |
| | SEM image Surface condition evaluation | Coating layer removal rate (%) | Detachment state evaluation | Saturation magnetization rate of change (%) | Rate of change evaluation | Electrical resistance rate of change (%) | Rate of change evaluation | measurement value (mg/L) | TOC evaluation | Overall evaluation |
| Example 1 | A | 97 | A | 0.9 | A | 0.6 | A | 3 | A | A |
| Example 2 | A | 98 | A | 0.2 | A | 0.9 | A | 5 | A | A |
| Example 3 | A | 94 | A | 0.8 | A | 0.5 | A | 584 | E | B |
| Example 4 | A | 83 | B | 2.1 | B | 1.7 | B | 13 | A | B |
| Example 5 | A | 93 | A | 2.8 | B | 3.5 | C | 10 | A | B |
| Example 6 | B | 81 | B | 2.5 | B | 3.9 | C | 8 | A | B |
| Example 7 | A | 90 | A | 2.3 | B | 1.3 | B | 4 | A | B |
| Example 8 | B | 81 | B | 2.9 | B | 2.7 | B | 2 | A | B |
| Comp. Ex. 1 | E | 28 | E | 13.6 | E | 13.5 | E | 11 | A | E |
| Comp. Ex. 2 | E | 32 | D | 12.8 | E | 11.3 | E | 18 | B | E |
| Comp. Ex. 3 | A | 90 | A | 5.8 | D | 9.2 | D | 124 | D | E |
| Comp. Ex. 4 | E | 35 | D | 6.2 | D | 14.2 | E | 15 | B | E |
| Comp. Ex. 5 | B | 80 | B | 5.3 | D | 12.0 | E | 218 | E | E |

Examples 1 and 2 resulted in a TOC measurement value significantly lower than Example 3 in which no catalyst was used.

Examples in which a cleaning step with microbubbles was performed (e.g. Examples 1 and 2) resulted in a coating layer removal rate superior to Examples 4 and 8 in which a cleaning step with microbubbles was not performed. These also resulted in smaller changes in magnetic property and electrical property.

Examples in which water used in an aqueous solution including an oxidant had an electrical conductivity at 25° C. of 10.0 μS·cm or less (e.g. Examples 1 and 2) resulted in a smaller changes in magnetic property and electrical property than Example 5 in which water had an electrical conductivity at 25° C. exceeding 10.0 μS·cm.

Examples in which an amount of an aqueous solution including an oxidant used with respect to a carrier for electrophotography as a mass ratio (aqueous solution/carrier for electrophotography) of 3 or greater (e.g. Examples 1 and 2) resulted in superior coating layer removal rate compared to Example 6 in which the mass ratio was less than 3. These also resulted in smaller changes in magnetic property and electrical property.

Examples in which the temperature during treatment was 340° C. or less (e.g. Examples 1 and 2) resulted in smaller changes in magnetic property and electrical property than Example 7 in which the temperature during treatment exceeded 340° C.

In the examples, a crosslinking resin having a silicone resin as a main component, which hardly dissolves in a solvent and is difficult to separate, was used as a coating layer. Nonetheless, according to the method for regenerating a carrier core material for electrophotography of the present invention, the carrier core materials for electrophotography were successfully separated from the coating layer, and the carrier core materials for electrophotography were successfully regenerated without affecting magnetic property and electrical property.

Also, owing to the treatment using a catalyst, the TOC of waste generated in the treating step was reduced. As a result, burden of processing the waste is reduced, or waste treatment was no longer needed.

Aspects of the present invention are as follows.

<1> A method for regenerating a carrier core material for electrophotography, including:

treating a carrier for electrophotography including a carrier core material for electrophotography and a coating layer on a surface of the carrier core material for electrophotography with an aqueous solution including an oxidant in a subcritical state or a supercritical state having a temperature of 280° C. or greater and a density of 0.20 g/cm$^3$ or greater, wherein an amount of the oxidant in a total amount of the aqueous solution used in the treating is greater than 0.05 parts by mass with respect to 1 part by mass of the carrier for electrophotography to be treated in the treating.

<2> The method for regenerating a carrier core material for electrophotography according to <1>, wherein the amount of the oxidant (Y) further satisfies Formula (1):

$$Y \geq 6.23 \times X - 0.03 \quad \text{Formula (1)}$$

wherein, in Formula (1), Y is the amount of the oxidant (in parts by mass) with respect to 1 part by mass of the carrier for electrophotography to be processed in the treating; and X is an amount of a toner (in parts by mass) processed with 1 part by mass of the carrier for electrophotography processed in the treating, and X includes 0.

<3> The method for regenerating a carrier core material for electrophotography according to any one of <1> to <2>, further including contacting a catalyst, wherein the aqueous solution including the oxidant in a supercritical state or a subcritical state used in the treating is brought into contact with the catalyst.

<4> The method for regenerating a carrier core material for electrophotography according to any one of <1> to <3>, further including cleaning, wherein the carrier core material for electrophotography after the treating is cleaned with water containing air bubbles.

<5> The method for regenerating a carrier core material for electrophotography according to any one of <1> to <4>, wherein water in the aqueous solution including the oxidant has an electrical conductivity at 25° C. of 10.0 μS·cm or less.

<6> The method for regenerating a carrier core material for electrophotography according to any one of <1> to <5>, wherein a mass ratio of the amount of the aqueous solution including the oxidant to the carrier for electrophotography in the treating (the aqueous solution including the oxidant/the carrier for electrophotography) is 3 or greater.

<7> The method for regenerating a carrier core material for electrophotography according to any one of <1> to <6>, wherein the aqueous solution including the oxidant in a supercritical state or a subcritical state in the treating has a temperature of 340° C. or less.

<8> A method for manufacturing a carrier for electrophotography, including at least:

treating a carrier for electrophotography including a carrier core material for electrophotography and a coating layer on a surface of the carrier core material for electrophotography with an aqueous solution including an oxidant in a subcritical state or a supercritical state having a temperature of 280° C. or greater and a density of 0.20 g/cm$^3$ or greater, wherein an amount of the oxidant in a total amount of the aqueous solution used in the treating is greater than 0.05 parts by mass with respect to 1 part by mass of the carrier for electrophotography to be treated in the treating.

<9> The method for manufacturing a carrier for electrophotography according to <8>, wherein the amount of the oxidant (Y) further satisfies Formula (1):

$$Y \geq 6.23 \times X - 0.03 \quad \text{Formula (1)}$$

wherein, in Formula (1), Y is the amount of the oxidant (in parts by mass) with respect to 1 part by mass of the carrier for electrophotography to be processed in the treating; and X is an amount of a toner (in parts by mass) processed with 1 part by mass of the carrier for electrophotography processed in the treating, and X includes 0.

<10> The method for manufacturing a carrier for electrophotography according to any one of <8> to <9>, further including contacting a catalyst, wherein the aqueous solution including the oxidant in a supercritical state or a subcritical state used in the treating is brought into contact with the catalyst.

<11> The method for manufacturing a carrier for electrophotography according to any one of <8> to <10>, further including cleaning, wherein the carrier core material for electrophotography after the treating is cleaned with water containing air bubbles.

<12> The method for manufacturing a carrier for electrophotography according to any one of <8> to <11>, wherein water in the aqueous solution including the oxidant has an electrical conductivity at 25° C. of 10.0 μS·cm or less.

<13> The method for manufacturing a carrier for electrophotography according to any one of <8> to <12>, wherein a mass ratio of the amount of the aqueous solution including the oxidant to the carrier for electrophotography in the treating (the aqueous solution including the oxidant/the carrier for electrophotography) is 3 or greater.

<14> The method for manufacturing a carrier for electrophotography according to any one of <8> to <13>, wherein the aqueous solution including the oxidant in a supercritical state or a subcritical state in the treating has a temperature of 340° C. or less.

<15> A carrier core material for electrophotography obtained by the method for regenerating a carrier core material for electrophotography according to any one of <1> to <7>.

<16> A carrier for electrophotography, including:

the carrier core material for electrophotography according to <15>, and a coating layer on a surface of the carrier core material for electrophotography.

<17> A carrier for electrophotography, manufactured by the method for manufacturing a carrier for electrophotography according to any one of <8> to <14>.

This application claims priority to Japanese application No. 2011-209577, filed on Sep. 26, 2011 and incorporated herein by reference.

What is claimed is:

1. A method for regenerating a carrier core material for electrophotography, comprising:

treating a carrier for electrophotography comprising a carrier core material for electrophotography and a coating layer on a surface of the carrier core material for electrophotography with an aqueous solution comprising an oxidant in a subcritical state or a supercritical state having a temperature of 280° C. or greater and a density of 0.20 g/cm$^3$ or greater, wherein an amount of the oxidant in a total amount of the aqueous solution used in the treating is greater than 0.05 parts by mass with respect to 1 part by mass of the carrier for electrophotography to be treated in the treating, wherein the carrier is mixed with a toner, and wherein the amount of the oxidant (Y) further satisfies Formula (1):

$$Y \geq 6.23 \times X - 0.03 \quad \text{Formula (1)}$$

wherein, in Formula (1), Y is the amount of the oxidant (in parts by mass) with respect to 1 part by mass of the carrier for electrophotography to be processed in the treating; and X is an amount of a toner (in parts by mass) processed with 1 part by mass of the carrier for electrophotography processed in the treating.

2. The method for regenerating a carrier core material for electrophotography according to claim 1, further comprising contacting a catalyst, wherein the aqueous solution comprising the oxidant in a supercritical state or a subcritical state used in the treating is brought into contact with the catalyst.

3. The method for regenerating a carrier core material for electrophotography according to claim 1, further comprising cleaning, wherein the carrier core material for electrophotography after the treating is cleaned with water containing air bubbles.

4. The method for regenerating a carrier core material for electrophotography according to claim 1, wherein water in the aqueous solution comprising the oxidant has an electrical conductivity at 25° C. of 10.0 μS·cm or less.

5. The method for regenerating a carrier core material for electrophotography according to according to claim 1, wherein a mass ratio of the amount of the aqueous solution comprising the oxidant to the carrier for electrophotography in the treating (the aqueous solution comprising the oxidant/the carrier for electrophotography) is 3 or greater.

6. The method for regenerating a carrier core material for electrophotography according to claim 1, wherein the aqueous solution comprising the oxidant in a supercritical state or a subcritical state in the treating has a temperature of 340° C. or less.

7. A method for manufacturing a carrier for electrophotography, comprising:

treating a carrier for electrophotography comprising a carrier core material for electrophotography and a coating layer on a surface of the carrier core material for electrophotography with an aqueous solution comprising an oxidant in a subcritical state or a supercritical state having a temperature of 280° C. or greater and a density of 0.20 g/cm$^3$ or greater, wherein an amount of the oxidant in a total amount of the aqueous solution used in the treating is greater than 0.05 parts by mass with respect to 1 part by mass of the carrier for electrophotography to be treated in the treating, wherein the carrier is mixed with a toner, and wherein the amount of the oxidant (Y) further satisfies Formula (1):

$$Y \geq 6.23 \times X - 0.03 \quad \text{Formula (1)}$$

wherein, in Formula (1), Y is the amount of the oxidant (in parts by mass) with respect to 1 part by mass of the carrier for electrophotography to be processed in the treating; and X is an amount of a toner (in parts by mass) processed with 1 part by mass of the carrier for electrophotography processed in the treating.

8. The method for manufacturing a carrier for electrophotography according to claim 7, further comprising contacting a catalyst, wherein the aqueous solution comprising the oxidant in a supercritical state or a subcritical state used in the treating is brought into contact with the catalyst.

9. The method for manufacturing a carrier for electrophotography according to claim 7, further comprising cleaning, wherein the carrier core material for electrophotography after the treating is cleaned with water containing air bubbles.

10. The method for manufacturing a carrier for electrophotography according to claim 7, wherein water in the aqueous solution comprising the oxidant has an electrical conductivity at 25° C. of 10.00 μS·cm or less.

11. The method for manufacturing a carrier for electrophotography according to claim 7, wherein a mass ratio of the amount of the aqueous solution comprising the oxidant to the carrier for electrophotography in the treating (the aqueous solution comprising the oxidant/the carrier for electrophotography) is 3 or greater.

12. The method for manufacturing a carrier for electrophotography according to claim 7, wherein the aqueous solution comprising the oxidant in a supercritical state or a subcritical state in the treating has a temperature of 340° C. or less.

* * * * *